US009922637B2

(12) United States Patent
Qiao

(10) Patent No.: US 9,922,637 B2
(45) Date of Patent: Mar. 20, 2018

(54) MICROPHONE NOISE SUPPRESSION FOR COMPUTING DEVICE

(71) Applicant: Microsoft Technology Licensing, LLC, Redmond, WA (US)

(72) Inventor: Tianzhu Qiao, Portland, OR (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 15/207,317

(22) Filed: Jul. 11, 2016

(65) Prior Publication Data

US 2018/0012585 A1 Jan. 11, 2018

(51) Int. Cl.

| | |
|---|---|
| ***G10K 11/16*** | (2006.01) |
| ***G10K 11/178*** | (2006.01) |
| ***H04R 3/00*** | (2006.01) |

(52) U.S. Cl.

CPC ..... *G10K 11/178* (2013.01); *H04R 3/005* (2013.01); *G10K 2210/129* (2013.01); *G10K 2210/3012* (2013.01); *G10K 2210/3028* (2013.01); *H04R 2410/05* (2013.01); *H04R 2499/15* (2013.01)

(58) Field of Classification Search

CPC ..... G10K 11/178; G10K 2210/129; G10K 2210/3012; G10K 2210/3028; H04R 3/005; H04R 2410/05; H04R 2499/15; G10L 21/0208; G10L 21/0201; G10L 21/02165

See application file for complete search history.

(56) References Cited

U.S. PATENT DOCUMENTS 4,956,867 A * 9/1990 Zurek ..... H04R 3/005 381/71.11
6,343,519 B1 2/2002 Callicott et al.
6,968,064 B1 11/2005 Ning
(Continued)

FOREIGN PATENT DOCUMENTS

WO 2006070044 A1 7/2006

OTHER PUBLICATIONS

Xia, H. et al. "Zero-Latency Tapping: Using Hover Information to Predict Touch Locations and Eliminate Touchdown Latency," 27th annual ACM symposium on User inferface software and technology (UIST'14), Oct. 5, 2014, Honolulu, Hawaii, 10 pages.
(Continued)

*Primary Examiner* — Andrew L Sniezek
(74) *Attorney, Agent, or Firm* — Alleman Hall Creasman & Tuttle LLP

(57) ABSTRACT

A computing device with a microphone system is disclosed. The computing device includes a microphone system with an environment microphone and a noise microphone. The environment microphone picks up an environment microphone signal which includes (1) a desired signal component based on desired sound and (2) a noise component based on noise from a noise source. The noise microphone picks up a noise microphone signal based on the noise, and is configured such that contributions to the noise microphone signal from the desired sound, if present, are attenuated relative to the environment microphone. A controller receives and processes time samples from the noise microphone signal to yield a noise estimation of the noise component. The estimation is subtracted from the environment microphone signal to yield and end-user output.

15 Claims, 5 Drawing Sheets

(56) References Cited

U.S. PATENT DOCUMENTS

| | | | | |
|---|---|---|---|---|
| 7,206,418 | B2 * | 4/2007 | Yang | H04R 3/005 381/92 |
| 8,019,089 | B2 | 9/2011 | Seltzer et al. | |
| 8,027,743 | B1 | 9/2011 | Johnston | |
| 8,170,200 | B1 | 5/2012 | Chu et al. | |
| 8,213,635 | B2 | 7/2012 | Li et al. | |
| 8,265,292 | B2 | 9/2012 | Leichter | |
| 8,462,958 | B2 | 6/2013 | Kuech et al. | |
| 8,743,062 | B2 | 6/2014 | Krah et al. | |
| 8,775,171 | B2 | 7/2014 | Sorensen et al. | |
| 8,867,757 | B1 | 10/2014 | Ooi | |
| 9,058,801 | B2 | 6/2015 | Po et al. | |
| 9,131,295 | B2 | 9/2015 | Kim et al. | |
| 9,173,023 | B2 | 10/2015 | Domingo Yaguez et al. | |
| 2003/0161484 | A1 * | 8/2003 | Kanamori | H04R 3/005 381/71.7 |
| 2009/0122024 | A1 | 5/2009 | Nakamura et al. | |
| 2009/0274315 | A1 | 11/2009 | Carnes et al. | |
| 2011/0013785 | A1 | 1/2011 | Kim | |
| 2011/0136479 | A1 | 6/2011 | Kim et al. | |
| 2012/0109632 | A1 | 5/2012 | Sugiura et al. | |
| 2013/0132076 | A1 | 5/2013 | Yang et al. | |
| 2013/0197905 | A1 * | 8/2013 | Sugiyama | G10L 21/0208 704/226 |
| 2013/0271426 | A1 | 10/2013 | Yumoto et al. | |
| 2014/0023210 | A1 | 1/2014 | Sheng et al. | |
| 2014/0294196 | A1 | 10/2014 | An et al. | |
| 2014/0324420 | A1 | 10/2014 | Sorensen et al. | |
| 2014/0327614 | A1 | 11/2014 | Park | |
| 2014/0331146 | A1 | 11/2014 | Ronkainen et al. | |

OTHER PUBLICATIONS

Anderson, Erik, "Reduce Display Noise in Capacitive Touchscreens", Published on: Jan. 28, 2013 Available at: http://mobiledevdesign.com/learning-resources/reduce-display-noise-capacitive-touchscreens.

"International Search Report and Written Opinion Issued in PCT Application No. PCT/US2017/040562", dated Aug. 31, 2017, 14 Pages.

Buchner, et al., "An Acoustic Keystroke Transient Canceler for Speech Communication Terminals Using a Semi-Blind Adaptive Filter Model", In Proceedings of the IEEE International Conference on Acoustics, Speech and Signal Processing (ICASSP), Mar. 20, 2016, pp. 614-618.

Schuldt, et al., "Adaptive Filter Length Selection for Acoustic Echo Cancellation", In Journal of Signal Processing, vol. 89, Issue 6, Jun. 1, 2009, pp. 1185-1194.

Asutosh, et al., "Dynamic Tap-Length Estimation Based Low Complexity Acoustic Echo Canceller", In Proceedings of the International Conference on Emerging Trends in Science, Engineering and Technology (INCOSET), Dec. 13, 2012, pp. 339-343.

* cited by examiner

MICROPHONE NOISE SUPPRESSION FOR COMPUTING DEVICE

BACKGROUND

Computing devices commonly include a microphone for capturing human voices or other desired environmental sounds. In some cases, however, objects can come in contact with parts of the computing device, causing vibrations that couple into the microphone to create noise. For example, styluses often create tapping sounds that can figure prominently in the output of the microphone, creating bothersome noise that distracts from the content that the user wants to be recorded.

DETAILED DESCRIPTION

Figure 1:
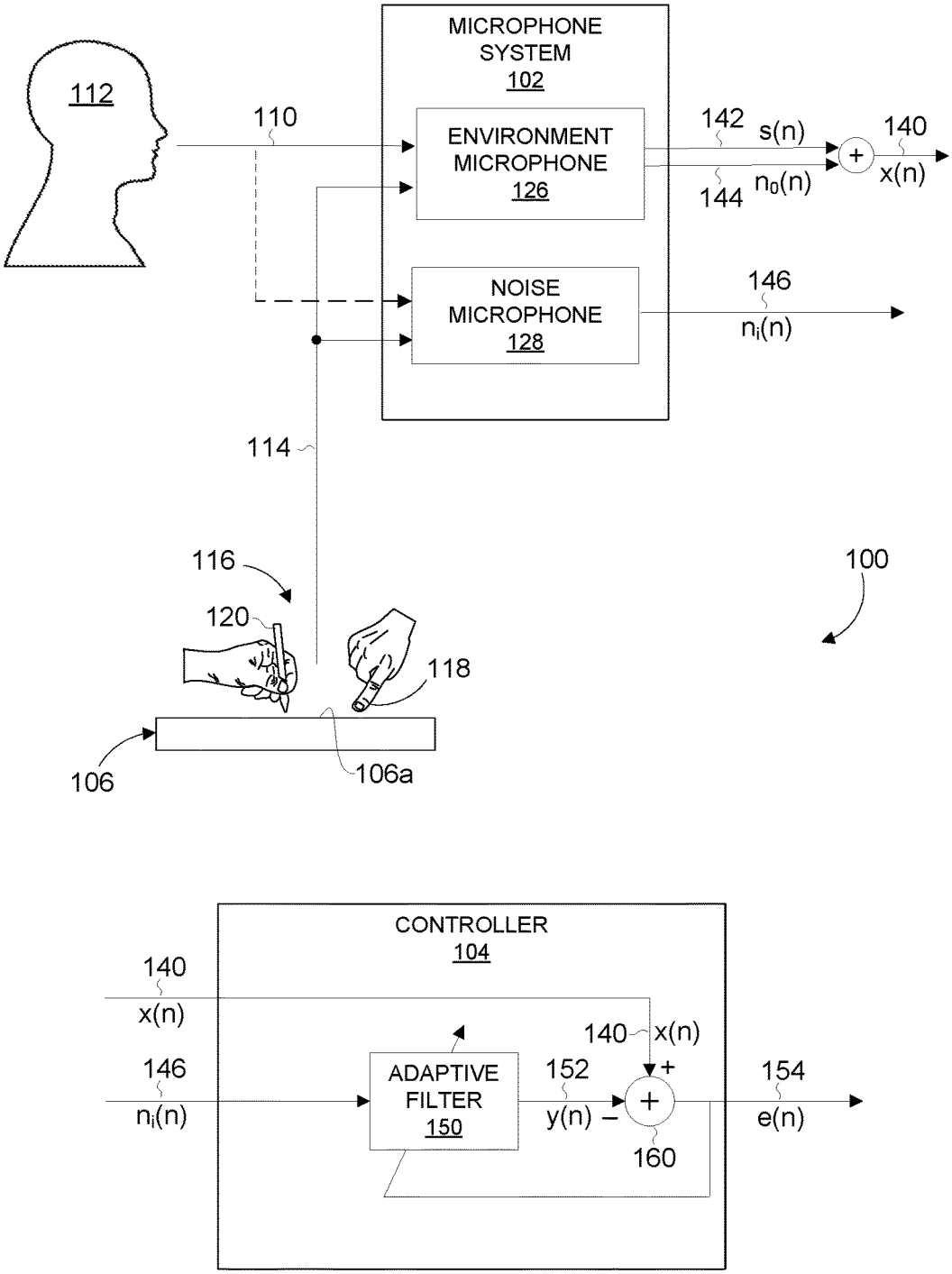
FIG. 1 schematically depicts an example computing device with a noise microphone configured to estimate a noise component present in the recorded content of an environment microphone.

Computing devices/systems typically include one or more microphones to record and process nearby sounds. In many cases, the environmental sound includes desired sound (e.g., human voices, such as during a meeting in a conference room), as well as noise from one or more noise sources. In the recording, the noise picked up by the microphone may be bothersome and distracting, and may inhibit the ability to hear desired sound.

A particular scenario where this can occur is if a microphone-equipped device includes a touch interactive display. Sounds from fingers or styluses can produce tapping sounds or vibration when they contact the display. Since microphones are often positioned near the display surface, vibrations transmitted through the display in particular can present significant noise issues in the recorded sound. Typically, tapping and similar noise is of less concern to users listening concurrently in the surrounding environment, as the users are often relatively far from the noise source, and/or the environmental sound dominates the noise for listeners in the room.

On the other hand, with respect to a microphone on a computing device that is being contacted by a stylus or other object, that noise source may be closer to the microphone than environmental sounds (e.g., human voices), and may travel via propagation paths that tend to amplify the noise (e.g., through vibrating cover glass on a touch screen). Therefore, the tapping noise can significantly compete and interfere with, in the signal picked up by the microphone, the desired sounds.

The present description contemplates a system for use with a computing device, in which multiple microphones are used in concert, with various processing techniques, to suppress undesired noise in recorded sounds. Various types of noise may be suppressed, though noise from objects contacting a computing device (e.g., a stylus) are noise sources that are targeted by many examples described herein.

Embodiments herein include a microphone system for a computing device having an environment microphone and a noise microphone, whose outputs are variously processed in order to suppress undesired noise in an ultimate end-user output. The environment microphone is configured to pick up an environment microphone signal which includes (1) a desired signal component based on desired sound, and (2) a noise component based on noise from a noise source. For example, the desired sound might be a human voice, and the noise source a stylus tapping against a touch screen. The noise microphone is configured to pick up a noise microphone signal based on noise from the noise source, i.e., in this example, noise from the stylus tapping.

The noise microphone may be aimed, located or otherwise configured so that the tapping noise is predominant relative to other sounds (e.g., a human voice). For example, the noise microphone might be inside the computing device, near the interior backside of the touch screen. Indeed, in many cases it will be desirable that the noise microphone is configured so that contributions from the desired sound in the noise microphone signal are attenuated relative to such contributions in the environment microphone signal. Various configurations may be employed, for example, to isolate the noise microphone from human voices or other environment sounds, so that the noise microphone primarily picks up the stylus tapping or other noise source.

It will be appreciated that the noise source produces a noise contribution in the signals of both the environment microphone and the noise microphone. However, the noise source signals travel along different propagation paths, and thus the contributions from the noise source typically differ from one another in the respective microphone signals. The contributions do derive from the same source, however (e.g., the stylus tapping), and thus they typically are highly correlated with one another. On the other hand, the desired environment sound is typically highly uncorrelated with the noise.

The above correlation states—i.e., (1) noise contributions in the two microphones are typically highly correlated; and (2) the noise is uncorrelated with the human speech or other desired sound—can be leveraged to distinguish noise from desired sound in the environment microphone. In particular, ongoing processing of samples may be employed so as to use the noise microphone signal to estimate the noise contribution in the environment microphone signal. More particularly, a controller may process various time samples from the noise microphone to yield the noise estimation, which may then be subtracted from the environment microphone signal to yield an end-user output in which the noise is mitigated. In some examples, adaptive filtering may be employed to cause the mechanism to converge on an increasingly accurate noise estimation, which may then be maintained until a change in conditions results, such as a significant change in the character of the noise, in which case the filter may reset and/or resume a convergence toward an optimal state.

Figure 5:
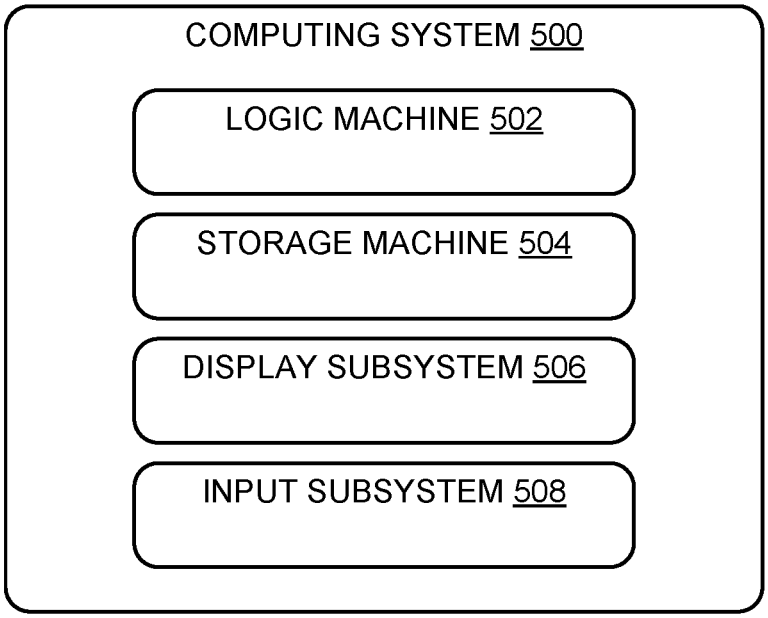
FIG. 5 depicts an example computing device/system that may be used in connection with aspects of the devices, systems and methods of FIGS. 1-4.

Turning now to the figures, FIG. 1 depicts a computing device 100 including a microphone system 102, a controller 104, and a touch-interactive display 106. Computing device 100 may be implemented in a variety of different form factors, including portable devices such as smartphones, tablet computers, laptops, and the like. Computing device 100 may also be implemented as a desktop computer, large-format touch device (e.g., wall-mounted), or any other suitable device. In typical implementations, as in the depicted example, the computing device will be a touch device, though non-touch configurations are possible. FIG. 5 describes various other features and components that may be implemented with computing device 100. In particular, the description of FIG. 5 describes that controller 104 may be implemented in processing hardware logic/circuitry and/or via execution of any other type of instructions.

Various sounds may occur in and around computing device 100, including desirable sounds, such as conversation occurring in a meeting, a musical performance, a teacher lecturing students, etc. FIG. 1 depicts desired sound 110 in the form of a human 112 talking, for example during a collaborative meeting using computing device 100. Undesirable noise may also occur, from a variety of sources. In the present example, noise 114 emanates from a noise source 116 associated with fingers 118 or a stylus 120 contacting the exterior surface 106*a* of touch-interactive display 106 of computing device 100.

Microphone system 102 includes an environment microphone 126 and a noise microphone 128. Though both microphones are within range of desired sound 110 and noise 114, they typically are differently-configured so that they pick up those sounds differently. In particular, as will be described in more detail below, the noise microphone is configured such that contributions it receives from the desired sound are attenuated relative to how the desired sound contributes to the environment microphone. In some examples, the noise microphone is isolated from the desired sound to a degree, for example by enclosing the noise microphone within computing device 100 so that the noise microphone primarily picks up stylus tapping vibrations on the backside of a display stack. In other cases, specially-adapted microphones may be used on the exterior of computing device 100 so that the specially-adapted microphones primarily capture noise 114 and minimize desired sound.

Environment microphone 126 picks up an environment microphone signal 140, also referred to at times herein as x(n), where (n) denotes a particular time, such that x(n) is a sample of the environment microphone signal 140 at time n. In some cases, the environment microphone signal will be denoted with x(_) as a general reference to the signal (i.e., not to a particular time). Similar notation will be used herein for other time samples/signals. Environment microphone signal x(n) includes a desired signal component 142 (also referred to as s(n)) based on the desired sound 110 and a noise component 144 (also referred to herein as $n_o(n)$) based on noise 114. Noise microphone 128 picks up a noise microphone signal 146 (also referred to as $n_i(n)$) based on noise 114. In some cases, desired sound 110 may make a non-trivial contribution to noise microphone signal $n_i(n)$, though typically there will be some type of isolation so that the noise will be a more significant contributor.

From the above, it will be appreciated that if environment microphone signal x(n) were directly output (e.g., to a remote participant), it would include the distracting noise component $n_o(n)$. Accordingly, the present systems and methods entail using output from the noise microphone 128 to estimate $n_o(n)$ and suppress/remove $n_o(n)$ from environment microphone signal x(n). In the case of display-related sounds, this can significantly improve the user experience, as those sounds can be substantial, particularly in the case of propagation paths through vibrating cover glass or other vibrating structures of a display device.

Controller 104 may process and respond to various inputs in order to estimate and suppress noise in environment microphone signal x(n). In some cases, this may entail use of an adaptive filter 150 that outputs a noise estimation 152 (also referred to as y(n)), as will be later explained. In any event, the inputs and outputs of the controller may be as follows: the controller receives x(n) (environment microphone signal 140) and $n_i(n)$ (noise microphone signal 146), and outputs end-user output 154 (also referred to as e(n)). The end-user output 154 is the noise-suppressed output signal provided for user consumption (e.g., subsequent playback, or contemporaneous transmission to a remote user). Generally, the controller may process a plurality of time samples $n_i(_)$ of the noise microphone signal 146 to yield the current time sample noise estimation y(n) of the current time sample noise component $n_o(n)$. In other words, the current noise estimation can be based not only on $n_i(n)$, but also on one or more prior samples of the noise microphone signal $n_i(\ )$. For example, the controller may process four samples of $n_i(—)$: $[n_i(n), n_i(n-1), n_i(n-2), n_i(n-3)]$. In other words, to derive noise estimation y(n), the sample for the current time is processed, as well as for the three preceding time samples of $n_i(_)$—with sampling occurring at any desired frequency. Preceding time samples of $n_i(_)$ typically contribute to the current time component $n_i(n)$ due to noise travelling on different propagation paths with associated different time delays. In other words, the noise time sample $n_i(n-3)$ has a longer propagation/delay path to the current time than does $n_i(n-2)$. In some examples, the current sample may not be employed, with only prior time samples being used. Also, consecutive time samples do not need to be used—one or more of the past samples may be skipped/omitted.

In any event, as shown in the controller depiction, the end-user output e(n) may be derived by subtracting noise estimation y(n) from environment microphone signal x(n) (e.g., via summer 160). In some examples, the adaptive behavior of the controller is implemented via feeding back the end-user output e(n) (e.g., to adaptive filter 150) in order to dynamically tune the noise estimation y(n).

Adaptive filter 150 may be configured to process multiple time samples of the noise microphone signal $n_i(_)$ to yield the noise estimation y(n) of the noise component $n_o(n)$ in the environment microphone signal x(n). The adaptive filter 150 may also be dynamically updated in the way that the adaptive filter 150 processes time samples to yield the noise estimation. As previously indicated, it may be assumed that the desired signal component s(n) is uncorrelated with noise component $n_o(n)$ or noise microphone signal $n_i(n)$. On the other hand, since noise component $n_o(n)$ and noise microphone signal $n_i(n)$ derive from the same source (e.g., stylus tap sound), they may be highly correlated to each other, even if they arrive at the respective microphones through different propagation paths. Accordingly, a filter may be applied to estimate the noise in the environment microphone signal x(n).

A variety of different filters may be employed. In some examples, coefficients are applied to different time samples of the noise microphone signal, such as applying coefficients to $n_i(n)$, $n_i(n-1)$, $n_i(n-2)$, etc. In some examples, coefficients are applied in an implementation of a linear filter. For example, noise estimation y(n) (i.e., the noise estimation at time n), may be derived as follows:

$$y(n)=\underline{w}^*\underline{n}_i \tag{1}$$

where $\underline{w}$ is a coefficient set and $\underline{n}_i$ is a set of noise microphone signal samples to which the coefficients are applied. Given N coefficients (a filter of order N), y(n) is as follows:

$$y(n)=w_0*n_i(n)+w_1*n_i(n-1)+w_2*n_i(n-2) \ldots w_{N-1}*n_i(n-N+1) \quad (2)$$

It will be appreciated that any number of coefficients may be employed to any number of samples. Due to various factors, such as location and type of noise, and placement of the noise microphone, the noise level may fall off significantly for longer delay paths. This accordingly may inform decisions about the order of the filter (i.e., how many preceding samples to process). In some cases, it may desirable to have a lower order filter to simplify processing. Also, though different types of filters may be employed, a linear filter may be desirable for many settings due to simpler calculation/processing. As will be described in more detail below, in some examples the order of the filter can be dynamically tuned during operation (e.g., via operation of controller 104).

In some implementations, since the desired signal component s(n) is uncorrelated with noise component $n_o(n)$ and noise microphone signal $n_i(n)$, the coefficient set $\underline{w}$ may be chosen to minimize the mean square error:

$$E(e(n)^2)=E((x(n)-y(n))^2), \quad (3)$$

where E(x) denotes the expectation of signal x. This implies that $$E(n_i(n-k)e(n))=0, \quad (4)$$

where k=[0, 1, 2, . . . , N−1]. In this case, the output e(n) does not correlate with the noise $n_i(n)$, which means the noise $n_o(n)$ is cancelled (at least significantly) from the environment microphone signal x(n).

If the noise propagation pattern is deterministic, a non-adaptive filter may be employed, in which desired filter coefficients are pre-calculated. For example, some equipment (e.g., an oscilloscope) may be used to capture the signal from both microphones to find the optimal solution during design time. In many settings, however, noise and noise propagation patterns may vary significantly (due to different styluses, different users, or different applications running on the computing device, to name a few examples). Accordingly, adaptive filter 150 may be employed, and configured to be dynamically updated (e.g., via operation of controller 104) to change the way in which the adaptive filter 150 processes time samples of the noise microphone signal to arrive at noise estimations. As mentioned above, in one implementation, dynamic updating is achieved by feeding back end-user output e(n) to the controller and adaptive filter 150.

In one example, filter coefficients applied to the time samples of the noise microphone signal may be dynamically updated. One example is a least mean squares updating as follows:

$$\underline{w}(n+1)=\underline{w}(n)+\mu*\underline{n}_i*e(n), \quad (5)$$

where $\underline{w}(n)$ is the current coefficient set at time n, and the $\underline{w}(n+1)$ is the updated coefficient set at time n+1. As indicated by the μ factor, the coefficients may be updated via a step size to tune how quickly they change from cycle to cycle. It will be appreciated from the above that the product of e(n) and $\underline{n}_i$ is used as feedback to adjust the coefficients for the next input sample. When the filter converges, it will be appreciated that, substantially, $y(n)=n_o(n)$ and e(n) is not correlated with $\underline{n}_i$. Thus, on average, $e(n)*\underline{n}_i=0$ and the coefficients remain stable per equation (5) above.

During operation, conditions may arise to disturb situations where the coefficients have converged or become highly settled. In one example, the relationship between the noise components may change. For example, a significant change may arise in the relationship between noise component $n_o(n)$ and noise microphone signal $n_i(n)$, or, irrespective of a change in relationship, one or both of those components may change significantly. This might occur, for example, if a different user were operating a stylus, or if the software running on the device called for operating the stylus in a different way (louder, softer, different tapping sounds).

In this example of changed conditions, the current coefficient set may at first yield a relatively undesirable noise estimation. In other words, noise estimation y(n) might differ significantly from noise component $n_o(n)$, in which case the remainder end-user output e(n)=x(n)−y(n) would still be highly correlated with $n_i(n)$ (i.e., the end-user output is noisy), which would cause the coefficients to be pushed back toward optimal, or more optimal, values (e.g., per equation (5) above). And, as indicated above, the filter may be configured to control the step size of coefficient changes in order to desirably control convergence rate, settling time, etc. of the filter coefficients. It will further be appreciated that the rapidity of change may be higher at first, given that the end-user output e(n) is highly correlated with $n_i(n)$. In other words, the higher the correlation, the more noise is present in the end-user output e(n), and in turn the filter will converge more aggressively, in the present example.

In coefficient implementations, the coefficients may be initialized to particular values. This may occur, for example, at boot time. The initialized coefficients may be selected based on expected average noise values. For example, testing during engineering across a range of scenarios may be used to derive coefficients keyed to learned noise profiles. Coefficient reset may occur during operation for various reasons, in which case the natural adjusting of coefficients by the filter is overridden by reset values (e.g., the ones used for booting). This might occur, for example, when there are very large changes in the noise character. Detecting such changes may be performed via observing changes in the relationship between the noise component $n_o(n)$ in the environment microphone signal x(n) and the noise microphone signal $n_i(n)$. Other detections may also lead to a coefficient reset. For example, the filter operation might be reset upon launch of a new application, switching to a different application, detecting stylus inputs from a different user, etc. When parameters are employed, a coefficient reset may be based on thresholds, such as a threshold change in noise, in the relationship between $n_o(n)$ and $n_i(n)$, etc.

Adaptive filtering with a linear filter in which coefficients are adjusted via least mean squares is but one example. Non-linear filters may be employed. Recursive methods may be applied, such as a recursive least squares mechanism. Other types of processing may be used, in which a function or multiple different functions are applied to multiple different inbound samples of the noise microphone signal $n_i(n)$.

It will be appreciated from the above that controller 104, among potential other functions, performs: (1) noise cancellation—e.g., subtracting noise estimations from the environment microphone signal 140; and (2) dynamic updating—e.g., updating the way the controller 104 processes samples to tune its noise estimations (e.g., through adaptive updating of filter coefficients).

In some examples, controller 104 is configured to selectively enable and disable the dynamic updating, e.g., the dynamic updating of filter coefficients of adaptive filter 150. In some cases, the selective enabling/disabling is performed in response to detecting a condition. One example of such a condition is detecting that the noise microphone signal is below a threshold value. It will be appreciated that the dynamic operation of adaptive filter 150 is performed, in part, to learn about noise coming from noise source 116. If no such noise is present, or if it is below some minimum threshold, continued dynamic updating can adaptively shift processing in a way that may not be beneficial when there is in fact non-trivial noise at a future time. In other words, there may be no noise component that can be used to train filter coefficients or other dynamic processing aspects. In other examples, the detected condition or its absence can include determining whether a stylus or finger is in contact with a touch surface (e.g., detecting "up" and "down" events via the touch sensor or another mechanism). Specifically, one example would be to turn on adaptive learning when a touch sensor records a contact event.

The above provides a specific example of conditions that can control dynamic updating (e.g., training adaptive filter 150). In general, the following four conditions can be used to determine the status of how controller 104 and adaptive filter 150 operate:

(1) noise microphone signal 146 is below a threshold AND environment microphone signal 140 is below a threshold;

(2) noise microphone signal 146 is below a threshold AND environment microphone signal 140 is above a threshold;

(3) noise microphone signal 146 is above a threshold AND environment microphone signal 140 is below a threshold; and (4) noise microphone signal 146 is above a threshold AND environment microphone signal 140 is above a threshold.

As mentioned above, it may be desirable to disable adaptive learning in cases (1) and (2) where there is low signal strength into the noise microphone. In some implementations, detection of one or more of the above conditions may be used to determine whether or not to perform noise canceling, i.e., subtracting noise estimation y(n) from environment microphone signal x(n). For example, when noise strength is low (cases (1) and (2) above), it may be desirable to turn off noise cancellation. On the other hand, in these cases, it may still be desirable to keel) the noise cancellation activated. This is due to the fact that the adaptive filter output may include a certain amount of background noise such as white noise. Therefore, when the noise cancellation is turned on, a remote user or someone listening to the recorded output may hear a higher volume of background noise. This potentially can sound more natural than a very silent output (e.g., absence of background noise may cause a remote user to think that the connection failed, or undesirable sound artifacts may arise from repeatedly enabling and disabling noise cancellation). Therefore, the noise cancellation function may be always enabled or, if turned off, generated/recorded background noise may be added to environment microphone signal x(n) so that it appears in end-user output e(n).

Case (3) above may present a desirable opportunity to enable the dynamic updating process by which controller 104 tunes the way it produces noise estimations. Specifically, the absence of environmental sound may improve the quality of the training (e.g., updating of filter coefficients). In this case, there is less environment sound to contribute to the signals, and the inputs to the tuning operation are therefore more aligned with the content that the adaptive filter is "learning" about.

As indicated above, adaptive filter 150 may have an order, i.e., order N, which refers to the number of coefficients used to scale various time samples $n_i(_)$ of the noise microphone signal. Various considerations may inform the choice of the order of the filter. In some examples, the order of the adaptive filter may be fixed at design time, for example with an algorithm implemented in hardware. In particular, due to propagation loss, the noise power in some cases may decrease greatly in terms of the propagation distance between the noise source and the microphone. Thus, coefficient scaling may only be needed for the first few propagation paths (i.e., a sample at time n and a relatively small number of preceding samples n−1, n−2). In other cases, a larger order may be appropriate, though this may involve accepting a tradeoff of more intense, time-consuming processing.

In other implementations, controller 104 may be configured to dynamically select the order of the filter. A dynamic learning process may be carried out in which different orders are applied to the signal path to assess performance. A range of orders may be applied to the signals in some examples, and performance of each order may be assessed to identify one or more orders that provide sufficiently desirable performance (e.g., end-user output 154 below some threshold value). One approach involves selecting, from among one or more orders that satisfy the threshold, a lowest order filter. In general, if two filters provide sufficient performance, it may be desirable to choose the lower order. As mentioned above, a lower order can involve less computational complexity. Also, it may reduce the potential of overfitting—i.e., sub-optimally cancelling desired sound.

The above dynamic selection of the order of the filter may be provided in response to detecting that the noise microphone signal 146 is above a threshold and the environment microphone signal is below a threshold (i.e., case (3) referred to above). This may be beneficial due to the absence or minimal presence of desired sound 110. In such case, significant changes to the operation of the filter may have less impact or be less noticeable to end users (i.e., consumers of end-user output e(n)). In some examples, the dynamic order selection occurs once at boot up, and then the same order is used throughout operation in other cases, order selection may be tuned during runtime.

To summarize options for how functionality may be triggered:

(1) Dynamic updating of the adaptive filter (e.g., learning coefficients may be turned on/off depending on whether significant noise is present). Updating may be performed while noise is above a threshold (e.g., in noise microphone signal 146) and disabled when below the threshold. In other examples, updating may continue regardless of the noise state.

(2) Noise subtraction (filtering) may be triggered to operate when the noise microphone signal 146 is above a threshold, and otherwise turned off. However, as indicated above, there may be situations relating to background noise when it is desirable to continue filtering even in the absence of significant noise. Other factors may also inform a decision to continue filtering when noise is below a threshold.

(3) When desired sound and noise are both significantly present, it will often be desirable to dynamically update the filter and cancel noise. In other cases, dynamic updating of the filter may be reserved for when only noise is present, as this potentially is more conducive to efficient learning of the coefficients.

(4) Dynamically selecting the order of the filter may be performed when only noise is present, through implementations are possible in which filter order is dynamically tuned at other times.

Figure 2:
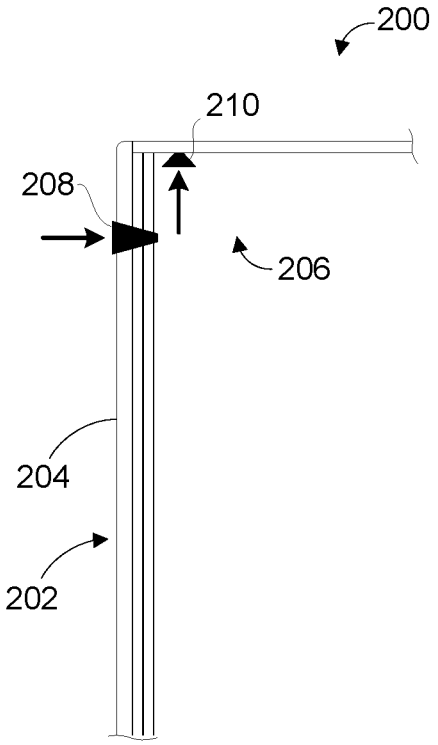
FIG. 2 schematically depicts a computing device including an example configuration of the microphone system of FIG. 1.

FIG. 2 depicts an example computing device 200, including a touch-interactive display 202 having an exterior surface 204. Similar to display 106 of FIG. 1, various touch inputs may be applied to exterior surface 204, thereby creating undesirable noise. Computing device 200 includes an enclosure 206, an environment microphone 208, and a noise microphone 210 within the enclosure 206. Microphone 208 points outward to the left, and thus is advantageously positioned to pick up human voices and other desirable environmental signals. The two microphones may correspond to the microphones described with reference to FIG. 1, and signals picked up by those microphones may be processed as described with reference to controller 104. The figure specifically depicts an arrangement that reduces non-noise signals from being significant contributors to what is received by the noise microphone 210. Specifically, the enclosure 206 to some extent isolates the noise microphone 210 from the human voices and other desired environment sounds (e.g., the desired signal component 142 of FIG. 1). In some settings, focusing the noise microphone on the noise source (e.g., stylus tapping) so as to reduce non-noise contributions can enhance the use of an adaptive filter—such as adaptive filter 150—to generate accurate noise estimations.

Figure 3:
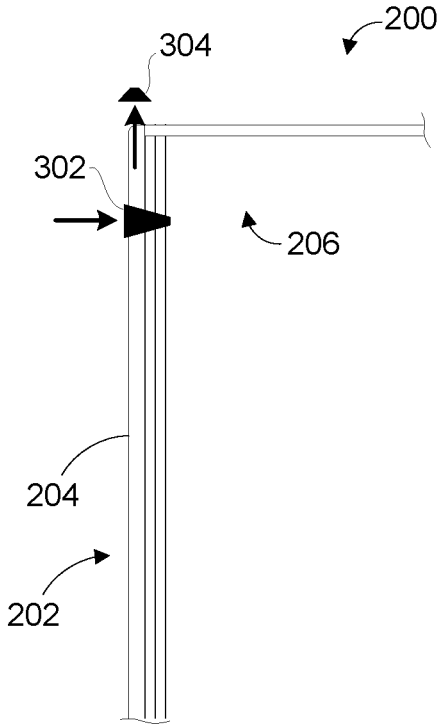
FIG. 3 schematically depicts the computing device of FIG. 2, including another example configuration of the microphone system of FIG. 1.

FIG. 3 depicts computing device 200 with an alternate microphone system including an environment microphone 302 and a noise microphone 304. As in FIG. 2, the environment microphone is configured so as to advantageously pick up human voices and other desired sounds. Also as in FIG. 2, these microphones and their signals may be processed as discussed with reference to FIG. 1. In this example, the noise microphone 304 is directed more toward the noise source (e.g., tapping on exterior surface 204) than is the environment microphone 302, which is omni-directional and/or aimed outward (to the left) toward where human voices and other desired sounds are likely to emanate from. The noise microphone may be mounted in various ways (mounting not shown) as appropriate to having it pick up significant signal power from the noise source. As in the previous examples, this implementation may provide a mechanism for causing desired sounds, if present in the noise microphone signal 146 (FIG. 1), to be attenuated relative to their contribution to the environment microphone signal 140, thereby enabling the noise microphone signal path to be more effectively used for generating noise estimations. In some examples, various directional microphone patterns may be employed (cardioid, super-cardioid, shotgun, etc.) for noise microphone 304 in order to generate a noise microphone signal that is focused primarily on noise, with minimal non-noise or environmental sound. In general, from the above, it will be appreciated that the noise microphone may be implemented with a directional character/configuration focused on the noise source, e.g., on its location, such as some part of a touch screen, housing or other component that transmits noise-related vibration.

Figure 4:
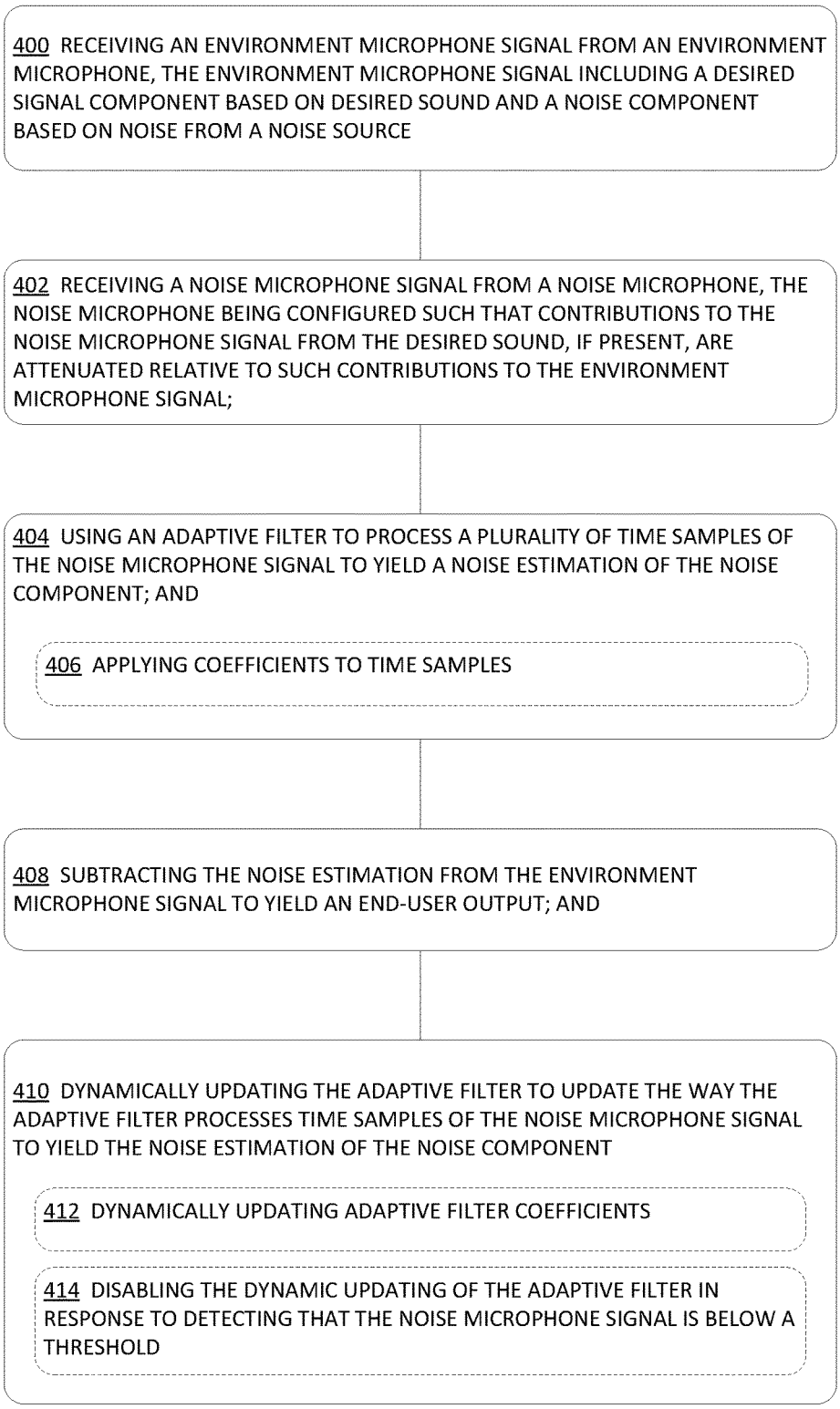
FIG. 4 depicts an example method for processing sound received by a microphone system of a computing device, such as the computing devices of FIGS. 1-3.

Referring now to FIG. 4, the figure depicts a method for processing sound received by a microphone system of a computing device. The description at times will refer to the systems described with reference to FIGS. 1-3, though it will be appreciated that a variety of different configurations may be employed in addition to or instead of those systems.

At 400, the method includes receiving an environment microphone signal from an environment microphone. The environment microphone signal includes a desired signal component based on a desired sound, and a noise component based on noise from a noise source. The noise source in some settings may be associated with styluses, pens, hands/fingers/thumbs, or other objects coming into contact with a touch-interactive display or other part of a computing device. The desired signal component may be associated with a human voice, music or any other suitable content that a user wishes to hear in a recorded audio signal.

At 402, the method includes receiving a noise microphone signal from a noise microphone. Typically, the noise microphone is configured so that it is at least relatively isolated from the desired sounds by comparison to an environment microphone. In other words, contributions to the noise microphone signal from desired sounds, if present, are attenuated relative to their presence in the environment microphone signal. As in the above examples, the noise microphone may be isolated via an enclosure, have a directional character focusing it on the noise source, or be otherwise configured so that its signal emphasizes the noise source over human speech or other desired environmental sounds.

As in the above systems example, the method may include receiving and processing a plurality of time samples of the noise microphone signal to yield a noise estimation of the noise component in the environment microphone signal. Adaptive filtering may be employed in connection with these time samples. Indeed, as shown at 404, the method may include using an adaptive filter to process a plurality of time samples of the noise microphone signal to yield a noise estimation of the noise component in the environment microphone signal. As shown at 406, this may include applying coefficients to the time samples.

As shown at 408, the method may include subtracting the calculated noise estimations from the environment microphone signal to yield an end-user output. Such output might be transmitted to a remote user, consumed by various users contemporaneously as the microphones are picking up the respective signals, etc. In any event, in many settings, stylus tapping and similar sounds can be significantly reduced from the signal received by the environment microphone.

As shown at 410, the method may include dynamically updating the way noise estimations are calculated. Specifically, the adaptive filter may be dynamically updated in the way that adaptive filter processes time samples of the noise microphone signal to yield its noise estimations of the noise component in the environment microphone signal. As shown at 412, this may include dynamically updating adaptive filter coefficients. As discussed above, the least mean squares and/or recursive least squares methods may be employed to cause coefficients to converge toward optimal values. As shown at 414, the method may also include disabling dynamic updating of the adaptive filter in response to one or more conditions. One condition in particular is detecting that the noise microphone signal is below a threshold value. As discussed above, it may be undesirable to train the adaptive filter if significant noise is not present.

In some embodiments, the methods and processes described herein may be tied to a computing system of one or more computing devices. In particular, such methods and processes may be implemented as a computer-application program or service, an application-programming interface (API), a library, and/or other computer-program product.

FIG. 5 schematically shows a non-limiting embodiment of a computing system 500 that can enact one or more of the methods and processes described above. Computing system 500 is shown in simplified form. Computing system 500 may take the form of one or more personal computers, server computers, tablet computers, home-entertainment computers, network computing devices, gaming devices, mobile computing devices, mobile communication devices (e.g., smart phone), and/or other computing devices. In many examples, as described above, the computing system typically will include a touch screen or other component that, when contacted with a stylus or other object, will vibrate so as to couple undesirable noise into one or more microphones.

Computing system 500 includes a logic machine 502 and a storage machine 504. Computing system 500 may also include a display subsystem 506, input subsystem 508, and/or other components not shown in FIG. 5.

Logic machine 502 may correspond to and/or be used to implement controller 104 of FIG. 1 and its noise estimation/subtraction and dynamic updating. It may include one or more physical devices configured to execute instructions. For example, the logic machine may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

The logic machine may include one or more processors configured to execute software instructions. For example, various functionalities described with reference to FIG. 1 and FIG. 4 may be implemented through software, hardware and/or firmware instructions. Additionally or alternatively, the logic machine may include one or more hardware or firmware logic machines configured to execute hardware or firmware instructions. Processors of the logic machine may be single-core or multi-core, and the instructions executed thereon may be configured for sequential, parallel, and/or distributed processing. Individual components of the logic machine optionally may be distributed among two or more separate devices, which may be remotely located and/or configured for coordinated processing. Aspects of the logic machine may be virtualized and executed by remotely accessible, networked computing devices configured in a cloud-computing configuration.

Storage machine 504 includes one or more physical devices configured to hold instructions executable by the logic machine to implement the methods and processes described herein. When such methods and processes are implemented, the state of storage machine 504 may be transformed—e.g., to hold different data.

Storage machine 504 may include removable and/or built-in devices. Storage machine 504 may include optical memory (e.g., CD, DVD, HD-DVD, Blu-Ray Disc, etc.), semiconductor memory (e.g., RAM, EPROM, EEPROM, etc.), and/or magnetic memory (e.g., hard-disk drive, floppy-disk drive, tape drive, MRAM, etc.), among others. Storage machine 504 may include volatile, nonvolatile, dynamic, static, read/write, read-only, random-access, sequential-access, location-addressable, file-addressable, and/or content-addressable devices.

It will be appreciated that storage machine 504 includes one or more physical devices. However, aspects of the instructions described herein alternatively may be propagated by a communication medium (e.g., an electromagnetic signal, an optical signal, etc.) that is not held by a physical device for a finite duration.

Aspects of logic machine 502 and storage machine 504 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

The terms "module," "program," and "engine" may be used to describe an aspect of computing system 500 implemented to perform a particular function. In some cases, a module, program, or engine may be instantiated via logic machine 502 executing instructions held by storage machine 504. It will be understood that different modules, programs, and/or engines may be instantiated from the same application, service, code block, object, library, routine, API, function, etc. Likewise, the same module, program, and/or engine may be instantiated by different applications, services, code blocks, objects, routines, APIs, functions, etc. The terms "module," "program." and "engine" may encompass individual or groups of executable files, data files, libraries, drivers, scripts, database records, etc.

It will be appreciated that a "service", as used herein, is an application program executable across multiple user sessions. A service may be available to one or more system components, programs, and/or other services. In some implementations, a service may run on one or more server-computing devices.

When included, display subsystem 506 may be used to present a visual representation of data held by storage machine 504. This visual representation may take the form of a graphical user interface (GUI). As the herein described methods and processes change the data held by the storage machine, and thus transform the state of the storage machine, the state of display subsystem 506 may likewise be transformed to visually represent changes in the underlying data. Display subsystem 506 may include one or more display devices utilizing virtually any type of technology. Such display devices may be combined with logic machine 502 and/or storage machine 504 in a shared enclosure, or such display devices may be peripheral display devices.

Input subsystem 508 may comprise or interface with one or more user-input devices such as a keyboard, mouse, touch screen, or game controller. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity. In connection with the foregoing examples, input subsystem 508 may include a microphone system having a noise microphone and an environment microphone. The signals picked up by these microphones may be processed as previously described to estimate and subtract noise from the environment microphone signal.

In one example, the present disclosure is directed to a computing device with a microphone system, including an environment microphone, a noise microphone, a controller and a summer. The environment microphone is configured to pick up an environment microphone signal that includes a desired signal component based on desired sound and a noise component based on noise from a noise source. The noise microphone is configured to pick up a noise microphone signal based on the noise from the noise source, where the noise microphone is configured such that contributions to the noise microphone signal from the desired sound, if present, are attenuated relative to such contributions to the environment microphone signal. The controller is configured to receive and process a plurality of time samples of the noise microphone signal to yield a noise estimation of the noise component. The summer is configured to subtract the noise estimation from the environment microphone signal to yield an end-user output.

In this example, the controller may include an adaptive filter configured to process the plurality of time samples of the noise microphone signal to yield the noise estimation, the adaptive filter being further configured to be dynamically updated in the way in which it processes time samples of the noise microphone signal to yield the noise estimation. The dynamic updating may be based on feedback of the end-user output to the controller. The adaptive filter may be configured to apply coefficients to each of the plurality of time samples of the noise microphone signal to yield the noise estimation, and where the dynamic updating includes updating of one or more of the coefficients. The updating may occur via a least mean squares or a recursive least squares filter/mechanism.

In this example, the controller may be configured to selectively enable and disable the dynamic updating of the adaptive filter in response to detecting a condition, which may include detecting that the noise microphone signal is below a threshold.

In this example, the controller may be configured to dynamically select an order of the adaptive filter, and such dynamic selection may be triggered by detecting that the noise microphone signal is above a threshold and the environment microphone signal is below a threshold.

In this example, the controller may be configured to disable noise estimation subtraction from the environment microphone signal in response to detecting a condition.

The computing device in this example may include an enclosure, where the environment microphone is outside of the enclosure and where the noise microphone is within the enclosure, and/or the noise microphone may have a directional configuration focused on a location of the noise source.

In another example, the disclosure is directed to a method for processing sound received by a microphone system of a computing device. The method includes: (1) receiving an environment microphone signal from an environment microphone, the environment microphone signal including a desired signal component based on desired sound and a noise component based on noise from a noise source; (2) receiving a noise microphone signal from a noise microphone, the noise microphone being configured such that contributions to the noise microphone signal from the desired sound, if present, are attenuated relative to such contributions to the environment microphone signal; (3) using an adaptive filter to process a plurality of time samples of the noise microphone signal to yield a noise estimation of the noise component; (4) subtracting the noise estimation from the environment microphone signal to yield an end-user output; and (5) dynamically updating the adaptive filter to update the way in which it processes time samples of the noise microphone signal to yield the noise estimation.

In this example, using the adaptive filter to process the plurality of time samples of the noise microphone signal may include applying coefficients to each of the plurality of time samples, the coefficients being dynamically updated based on feedback of the end-user output to the adaptive filter.

In this example, the method may further include disabling the dynamic updating of the adaptive filter in response to detecting that the noise microphone signal is below a threshold.

In this example, the method may further include dynamically selecting an order of the adaptive filter in response to detecting that the noise microphone signal is above a threshold and the environment microphone signal is below a threshold.

In yet another example, the disclosure is directed to a computing device with a microphone system. The computing device includes: (1) an environment microphone configured to pick up an environment microphone signal that includes a desired signal component based on desired sound and a noise component based on noise from a noise source; (2) a noise microphone configured to pick up a noise microphone signal based on the noise from the noise source, where the noise microphone is configured such that contributions to the noise microphone signal from the desired sound, if present, are attenuated relative to such contributions to the environment microphone signal; (3) a controller including an adaptive filter configured to receive and process a plurality of time samples of the noise microphone signal to yield a noise estimation of the noise component, the adaptive filter being configured to be dynamically updated in the way in which it processes time samples of the noise microphone signal to yield the noise estimation; and (4) a summer configured to subtract the noise estimation from the environment microphone signal to yield an end-user output. In this example, the controller is configured to disable the dynamic updating of the adaptive filter in response to detecting that the noise microphone signal is below a threshold.

In this example the controller may be configured to dynamically select an order of the adaptive filter, and the computing device may include an enclosure, with the environment microphone being outside of the enclosure and the noise microphone being within the enclosure.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A computing device with a microphone system, comprising:

an environment microphone configured to pick up an environment microphone signal that includes a desired signal component based on desired sound and a noise component based on noise from a noise source;

a noise microphone configured to pick up a noise microphone signal based on the noise from the noise source, where the noise microphone is configured such that contributions to the noise microphone signal from the desired sound, if present, are attenuated relative to such contributions to the environment microphone signal;

a controller having an adaptive filter configured to receive and process a plurality of time samples of the noise microphone signal to yield a noise estimation of the noise component, the controller being configured to dynamically update such reception and processing by dynamically selecting an order of the adaptive filter;

a summer configured to subtract the noise estimation from the environment microphone signal to yield an end-user output; and an enclosure, where the environment microphone is outside of the enclosure and where the noise microphone is within the enclosure.

2. The computing device of claim 1, where the dynamic updating is based on feedback of the end-user output to the controller.

3. The computing device of claim 1, where the adaptive filter is configured to apply coefficients to each of the plurality of time samples of the noise microphone signal to yield the noise estimation, and where the dynamic updating includes updating of one or more of the coefficients.

4. The computing device of claim 3, where the coefficients are updated via a least mean squares mechanism.

5. The computing device of claim 3, where the coefficients are updated via a recursive least squares filter.

6. The computing device of claim 1, where the controller is configured to selectively enable and disable the dynamic updating of the adaptive filter in response to detecting a condition.

7. The computing device of claim 6, where the controller is configured to disable the dynamic updating of the adaptive filter in response to detecting the noise microphone signal being below a threshold.

8. The computing device of claim 1, where the controller is configured to perform the dynamic selection of the order of the adaptive filter in response to detecting that the noise microphone signal is above a threshold and the environment microphone signal is below a threshold.

9. The computing device of claim 1, where the controller is configured to disable noise estimation subtraction from the environment microphone signal in response to detecting a condition.

10. The computing device of claim 1, where the noise microphone has a directional configuration focused on a location of the noise source.

11. A method for processing sound received by a microphone system of a computing device, comprising:

receiving an environment microphone signal from an environment microphone outside of an enclosure of the computing device, the environment microphone signal including a desired signal component based on desired sound and a noise component based on noise from a noise source;

receiving a noise microphone signal from a noise microphone within the enclosure, the noise microphone being configured such that contributions to the noise microphone signal from the desired sound, if present, are attenuated relative to such contributions to the environment microphone signal;

using an adaptive filter to process a plurality of time samples of the noise microphone signal to yield a noise estimation of the noise component;

subtracting the noise estimation from the environment microphone signal to yield an end-user output; and dynamically updating the adaptive filter to update the way in which it processes time samples of the noise microphone signal to yield the noise estimation, by dynamically selecting an order of the adaptive filter.

12. The method of claim 11, where using the adaptive filter to process the plurality of time samples of the noise microphone signal includes applying coefficients to each of the plurality of time samples, and where dynamically updating the adaptive filter further includes the coefficients being dynamically updated based on feedback of the end-user output to the adaptive filter.

13. The method of claim 11, further comprising disabling the dynamic updating of the adaptive filter in response to detecting that the noise microphone signal is below a threshold.

14. The method of claim 11, where dynamically selecting an order of the adaptive filter is done in response to detecting that the noise microphone signal is above a threshold and the environment microphone signal is below a threshold.

15. A computing device with a microphone system, comprising:

an environment microphone configured to pick up an environment microphone signal that includes a desired signal component based on desired sound and a noise component based on noise from a noise source;

a noise microphone configured to pick up a noise microphone signal based on the noise from the noise source, where the noise microphone is configured such that contributions to the noise microphone signal from the desired sound, if present, are attenuated relative to such contributions to the environment microphone signal;

a controller including an adaptive filter configured to receive and process a plurality of time samples of the noise microphone signal to yield a noise estimation of the noise component, the adaptive filter being configured to be dynamically updated in the way in which it processes time samples of the noise microphone signal to yield the noise estimation by dynamically selecting an order of the adaptive filter;

a summer configured to subtract the noise estimation from the environment microphone signal to yield an end-user output; and an enclosure, where the environment microphone is outside of the enclosure and where the noise microphone is within the enclosure, where the controller is configured to disable the dynamic updating of the adaptive filter in response to detecting the noise microphone signal is below a threshold.

* * * * *